US006609398B2

(12) United States Patent
Plath

(10) Patent No.: US 6,609,398 B2
(45) Date of Patent: Aug. 26, 2003

(54) NEEDLE FOR KNITTING, WARP KNITTING OR HOSIERY MACHINES AND A KNITTING MACHINE EQUIPPED THEREWITH

(75) Inventor: Ernst-Dieter Plath, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 10/322,872

(22) Filed: Dec. 18, 2002

(65) Prior Publication Data

US 2003/0121292 A1 Jul. 3, 2003

(30) Foreign Application Priority Data

Dec. 18, 2001 (DE) ..... 101 64 550

(51) Int. Cl.[7] ..... D04B 35/06
(52) U.S. Cl. ..... 66/120; 66/116
(58) Field of Search ..... 66/116, 120, 123, 66/124, 117

(56) References Cited

U.S. PATENT DOCUMENTS 189,500 A * 4/1877 Salisbury ..... 66/120
1,364,088 A * 1/1921 Fenn ..... 66/13
1,385,929 A 7/1921 Scott
1,461,007 A * 7/1923 Taft ..... 66/120
RE15,741 E 1/1924 Scott
1,483,009 A * 2/1924 Page ..... 66/120
1,563,233 A * 11/1925 Scott ..... 66/120
2,913,888 A * 11/1959 Amidon ..... 66/204

* cited by examiner

*Primary Examiner*—Danny Worrell
(74) *Attorney, Agent, or Firm*—Michael J. Striker

(57) ABSTRACT

The invention describes a compound needle having a needle part (3) and a slide part (4) for knitting, warp knitting or hosiery machines. The needle part (3) has a needle shaft (3*a*) and a needle hook (3*b*), the needle shaft (3*a*) being provided with a slot-shaped recess (3*f*) and a guide channel. The slide part has a slide shaft (4*a*), which is insertable into the guide channel and is movable to and fro in the latter, and a slide hook (4*b*) which is open in the opposite direction to the needle hook (3*b*), said slide hook being insertable into the recess (3*f*) in order to take over a stitch (9) located on the needle shaft (3*a*). According to the invention, the guide channel is provided with a cover (16) bridging the slide shaft (4*a*) at least on a part of its length, and the thickness of the slide hook (4*b*) is greater at least in a spread portion taking over the stitch (9) and keeping it wide than the width of the guide channel, and/or the thickness of the needle hook (3*b*) is smaller than the thickness of the needle shaft (3*a*). In addition, a knitting machine equipped with compound needles of this type is described (FIG. 7).

15 Claims, 10 Drawing Sheets

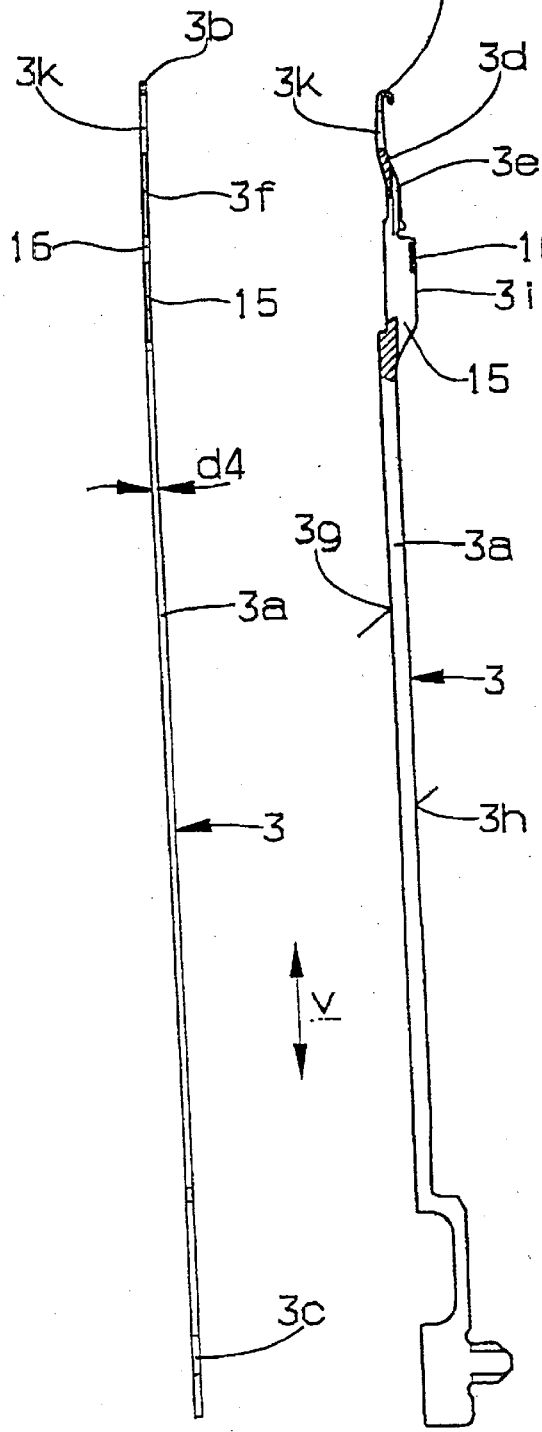
Fig. 11
Fig. 10
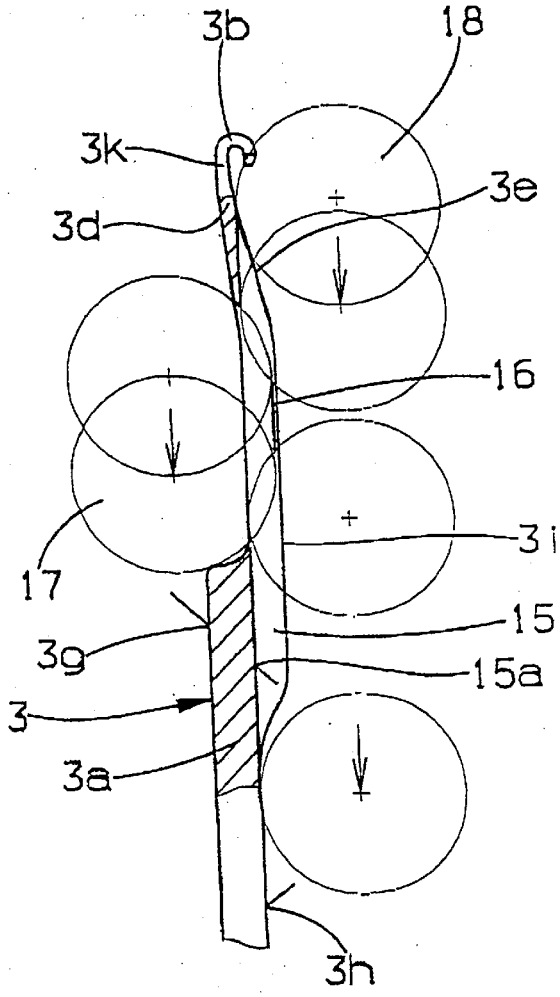
Fig. 12

NEEDLE FOR KNITTING, WARP KNITTING OR HOSIERY MACHINES AND A KNITTING MACHINE EQUIPPED THEREWITH

BACKGROUND OF THE INVENTION

The invention relates to a compound needle for knitting, warp knitting or hosiery machines, comprising: a needle part with a needle shaft and a needle hook, the needle shaft having a front side with a slot-shaped recess, a rear side, a longitudinal direction and a guide channel extending in the longitudinal direction, and a slide part with a slide shaft, which is insertable into the guide channel and is moveable to and fro in the latter, and with a slide hook which is open in the opposite direction to the needle hook, the slide hook being insertable at least partially into the recess in order to take over a stitch located on the needle shaft. The invention also relates to a knitting machine of any kind and being provided with compound needles mentioned above.

When using a hook-type needle, the thread is placed over the needle shaft by means of a first sinker as a loop, i.e. sunk, and then is inserted into the needle hook. Thereafter, the needle hook is closed by means of a pressing element and the old stitch, which is still located on the needle shaft, is pressed over the needle hook, i.e. knocked over. In contrast to the advantage of a regular and clean stitch formation there are also various disadvantages. These reside in the fact that, in order to open and close the needle hook, additional and controllable elements are required, for which reason a lot of space is necessary, the machines can only be provided with a small number of systems and the achievable outputs and the pattern options are low.

The predominant use nowadays of latch-type needles makes possible an automatic closing and opening of the hooks in contrast due to the pivotably mounted latches so that additional elements are not required for this purpose. The use of latch-type needles offers the advantages in addition of a low spatial requirement and also the possibility resulting therefrom of a large system number and achievable high output. Finally, when using latch-type needles, patterns which cannot be produced with hook-type needles can be produced, such as numerous different machine types demonstrate (e.g. right/left, right/right and left/left machines). A not unsubstantial disadvantage of latch-type needles exists however in the fact that the beginning of a knitting process cannot be automated because the automatic process of the latch opening makes it a precondition that stitches are already located in the needle hooks. It is therefore necessary to open the needle latches manually at the beginning of each knitting process, which is laborious and time-consuming.

This disadvantage can be avoided by using two-part compound needles, described subsequently as "normal", in which the hooks are opened and closed by means of a moveable slide which is controllable by means of needle cams. In addition, the advantage is given relative to latch-type needles that there are no pivotable parts which can become worn with high operating speeds or can be destroyed by breakage. However against these advantages there are disadvantages, in that the insertion of the threads into the needle hooks is problematic and it cannot be reliably avoided when using double-bed knitting machines (for example circular knitting machines with needle cylinders and dials) that faults are produced in the stitch formation. Normal compound needles have therefore only been partly successful in the case of circular knitting machines and also only with right/left machines. In contrast, compound needles of this type have been used widely with warp knitting machines because the threads can be inserted here by means of the eye needles securely into the needle hooks and hence the controlled movements of the slides can be fully exploited.

A further type of stitch formation, which has not yet been applied to date in practice, starts from a two-part needle of the type described initially (U.S. Pat. No. 1,385,929 and U.S. Pat. No. Re. 15,741). This needle, which is described subsequently as "modified" compound needle, differs as do other comparable needles of this type from the above-mentioned normal compound needle in that its slide part has a catch or securing hook, which is described subsequently as "slide hook" and essentially is disposed mirror-symmetrically to the needle hook of the associated needle part, i.e. is opened towards the front side of the needle part. The stitch formation is effected here in that a stitch, which is suspended on the shaft of the needle part and produced in a preceding stitch formation process, is caught by the slide hook and is secured whilst the needle part is simultaneously withdrawn in order to pull a thread placed in the needle hook through the "old" stitch retained by the slide hook so as to form a loop. In the further course, the slide hook is then firstly raised somewhat in order to release the old stitch, whereupon the needle part is also raised in order that, on the one hand, the newly formed loop or stitch slides onto its shaft and, on the other hand, the needle hook can take up a further thread. A needle of this type has like a normal compound needle the advantage that it enables an automatic commencement of the knitting process. In contrast to a normal compound needle, the modified compound needle is suited above all for machines with two knitting beds because the old stitch can always be retained in the slide hook until the new thread loop has slipped securely into the needle hook.

One problem occurring during tests on the modified compound needle resides in the fact that the slide hook does not always reliably take over the old stitch suspended on the shaft of the needle part. Especially when using hairy yarns and filament yarns, it was observed that the slide hook only takes over the old stitch in part and double stitches are formed. When knitting small stitches, faults are produced moreover in that the needle hook becomes partly stuck in the thread of the old stitch retained by the slide hook. Thus the modified compound needles to date cannot be used in general despite their advantages to replace hook-type needles, latch-type needles or normal compound needles, in particular if knitted articles are to be produced which have small dense stitches. Practical applications of the modified compound needles have therefore not become known to date.

One main reason for the portrayed disadvantages seems to reside in the fact that, in the needles of this type which have become known to date, the shanks of the newly formed stitch retained by the slide hook, at least at the very moment in which the needle hook carrying the new thread is intended to be moved through the old stitch, are situated very closely next to each other because of the selected needle construction and hence the intermediate space between the stitch shanks cannot be readily passed by the needle hook. This difficulty is increased even more by the vibrations which are unavoidable during operation of a knitting or hosiery machine. Also the control of the slide part on the needle part by means of a tongue and groove connection and a collar spring encompassing the slide parts at the external circumference do not contribute to improving the stitch formation. Finally, the known needle construction demands additional machining of the slide hook in order that the latter enters reliably into a recess configured in the needle shaft upon takeover of the old stitch, as a result of which sharp corners and edges are formed which can damage the sensitive thread material.

SUMMARY OF THE INVENTION

With this background in mind it is an object of this invention to design the compound needle specified above such that the needle hook can enter reliably into the old stitch under all conditions which may come across in practice during normal knitting.

A further object of this invention is to design the compound needle specified above such that the risk of damage to the old stitches or to the threads forming the stitches is extensively avoided.

Yet another object of the invention is to provide a needle of the type described above which is suitable also for producing a clean and uniform stitch structure even during production of small and tight stitches and also when using critical yarns, such as for example hairy yarns or filament yarns, without the threads which are used being torn or being cut through.

Further, it is also an object of this invention to suggest a knitting machine being provided with compound needles according to this invention.

These and other objects are solved by a compound needle of the type specified above which is characterized in that the guide channel has a cover bridging the slide shaft at least on a part of its length and in that the thickness of the slide hook is greater at least in a spread portion taking over the stitch and keeping it wide than the width of the guide channel, and/or the thickness of the needle hook is smaller than the thickness of the needle shaft, and further in that a knitting machine is provided with such compound needles.

The invention offers on the one hand the advantage that the slide part is mounted displaceably on the needle part in a manner which has proved its worth in the case of normal compound needles and which also ensures in the case of the modified compound needles according to the invention that the slide part is guided reliably and with narrow tolerances on the needle part during operation of a knitting or hosiery machine in all occurring conditions, in particular with the normal temperature increases. Consequently, any relative movements between the needle part and the slide part which are radial and effected perpendicularly to the longitudinal direction and are detrimental to a clean guidance of the needle hook through the old stitch, are extensively eliminated. On the other hand, compensation is made according to the invention for the comparatively small thickness of the slide shaft, conditioned in principle by the narrow guide, at that point at which the stitch formation takes place, in that either the slide hook is selected to be thicker than corresponds to the guide groove in the needle part, or the thickness of the needle hook relative to the needle shaft is reduced and consequently is approximately the width of the guide channel. In this manner, the spacing of the stitch legs at the moment at which the old stitch is passed by the needle hook is spread sufficiently widely and consequently it can be avoided in conjunction with the reliable guidance of the slide part on the needle part that the needle hook or its free tip is inserted into the stitch shanks and damages these or even forms double stitches. One particular advantage of the needle construction according to the invention resides finally in the fact that neither individual portions of the slide shaft or of the slide hook nor individual portions of the needle hook need be machined in such a manner which leads to sharp edges or the like and hence to damage of the sensitive yams during the stitch formation process.

Further advantageous features of the invention are produced from the sub-claims.

BRIEF DESCRIPTION OF THE DRAWINGS

The invention is explained subsequently in more detail with reference to the embodiments in conjunction with the accompanying drawings, which show:

FIG. 10 a partially sectioned lateral view of a needle part of a compound needle according to the invention;

FIG. 11 a front view of the needle part according to FIG. 10;

FIG. 12 an enlarged partial view of the needle part according to FIG. 10 for explaining the production of a guide channel;

DESCRIPTION OF PREFERRED EMBODIMENTS

Figure 1A:
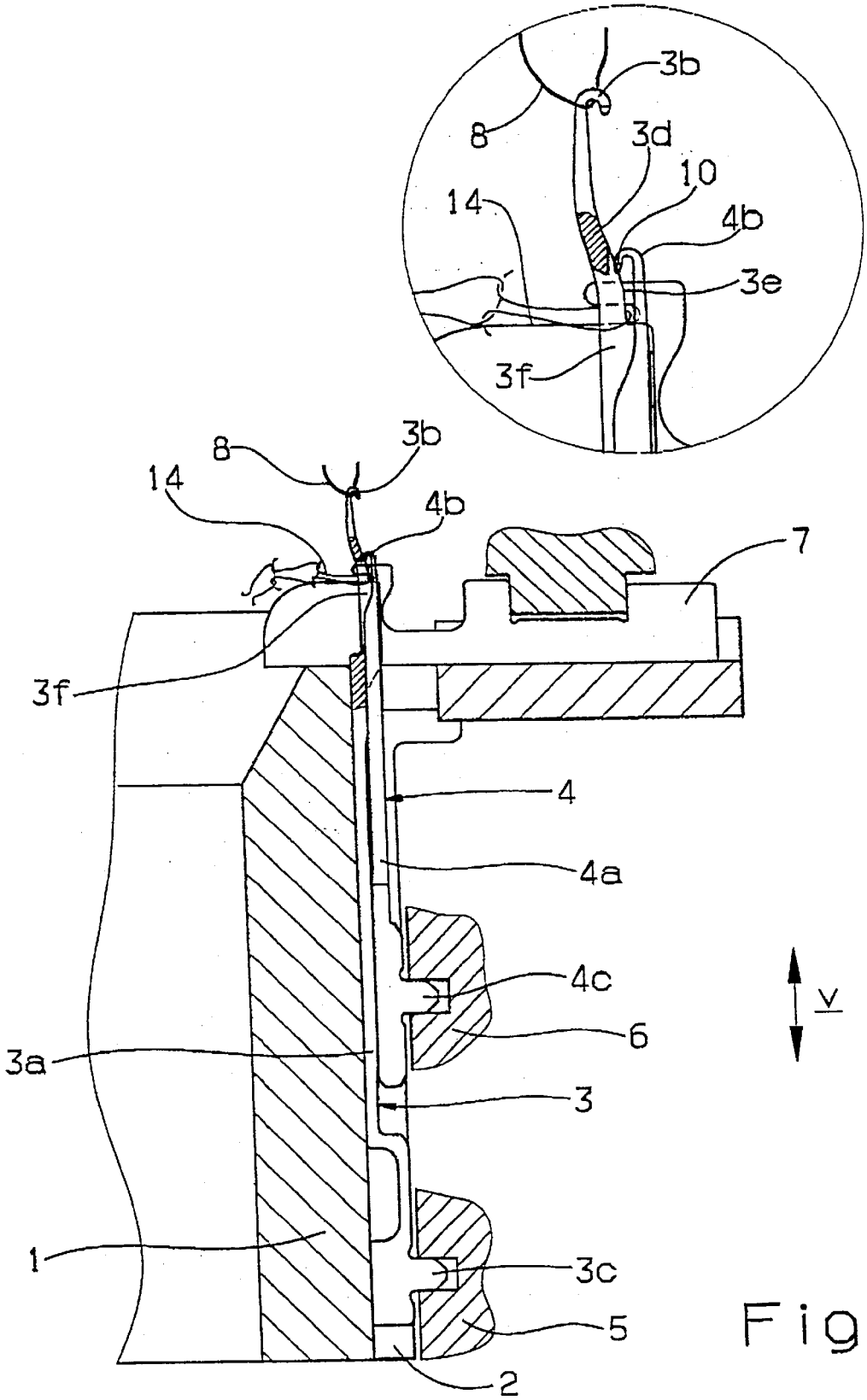
FIG. 1*a* schematic vertical section through a circular knitting machine equipped with a needle according to the invention and also an enlarged detail in a stitch formation region.

In FIG. 1, only the parts of a circular knitting machine which are essential for understanding of the invention are illustrated. The shown parts serve to explain subsequently the compound needle according to the invention and to represent also all other knitting, warp knitting and hosiery machines which may also be used. The circular knitting machine contains a schematically illustrated needle cylinder 1, which is preferably mounted rotatably in a machine frame, and the axis of rotation of said needle cylinder which is not visible in FIG. 1 being disposed vertically. At its circumference, the needle cylinder 1 has a multitude of radial webs 2, the spacings of which depend upon the gauge of the circular knitting machine and between which modified compound needles according to the present invention are mounted.

The compound needles contain respectively one needle part 3 and one slide part 4. The needle part 3 contains a needle shaft 3*a*, a needle hook 3*b*, which is formed on its upper end, and a needle butt 3*c* which is formed in a central or lower part on the needle shaft 3*a*. As in the case of normal compound needles, the needle hook 3*b* is opened radially outwardly and the needle butt 3*c* extends radially outwardly. In a similar manner, the slide part 4 has a slide shaft 4*a*, a slide hook 4*a* formed on its upper end and a slide butt 4*c* which is provided in a central or lower part of the slide shaft 4*a*. The slide hook 4*b*, which is not present in the case of normal compound needles, is bent and opened in the opposite direction to the needle hook 3*b*, i.e. bent and opened radially inwardly, whilst the slide butt 4*c* like the needle butt 3*c* points radially outwardly.

The slide shaft 4*a* abuts with its internal (rearward) end face against the external (front) end face of the needle shaft 3*a*. Since each pair comprising needle part 3 and slide part 4 is disposed in an associated channel formed between two webs 2, both can perform vertical up and down movements in this channel, as is indicated in FIG. 1 by a double arrow v which extends parallel to the longitudinal direction both of the needle shaft 3*a* and of the slide shaft 4*a*. These movements are generated preferably by schematically indicated needle cams 5 and 6 which are provided in a known manner on a cam housing surrounding the needle cylinder 1. In addition, preferably a sinker ring is assigned to the needle cylinder 1, in which sinker ring normal holding-down and knock-over sinkers 7 are disposed displaceably, horizontally and radially. Finally, the circular knitting machine has thread guides which are not shown in detail, by means of which a thread 8 is fed to the needle hook 3*b* in order to form stitches therefrom.

Between the needle hook 3*b* and the needle butt 3*c*, the needle shaft 3*a* in the embodiment has a front portion 3*d* which abuts against the needle hook 3*b*, is bent or widens out radially outwardly and is generally described as needle breast, and has a cheek portion 3*e* abutting thereon in the direction of the needle butt 3*c*. The cheek portion 3*e* is extended in the longitudinal direction (arrow v) and provided with a slot-shaped recess 3*f* which is incorporated into the radially outwardly situated end face and is open towards the latter and also upwardly. The relative positions of the two hooks 3*b* and 4*b* are chosen such that they can be moved past each other in the direction of the arrow v without touching but that an inwardly protruding tip 10 of the slide hook 4*b* enters at least partially radially into the slot-shaped recess 3*f* when the slide part 4 is moved downwardly relative to the needle part 3.

Knitting machines of this type are generally known (e.g. U.S. Pat. No. 1,385,929) and do not require to be explained therefore in more detail to the person skilled in the art.

A stitch formation process proceeds when using a circular knitting machine according to FIG. 1 as is likewise known per se, for instance, in the manner which is evident in FIGS. 2–9 and is subsequently explained briefly.

Figure 2:
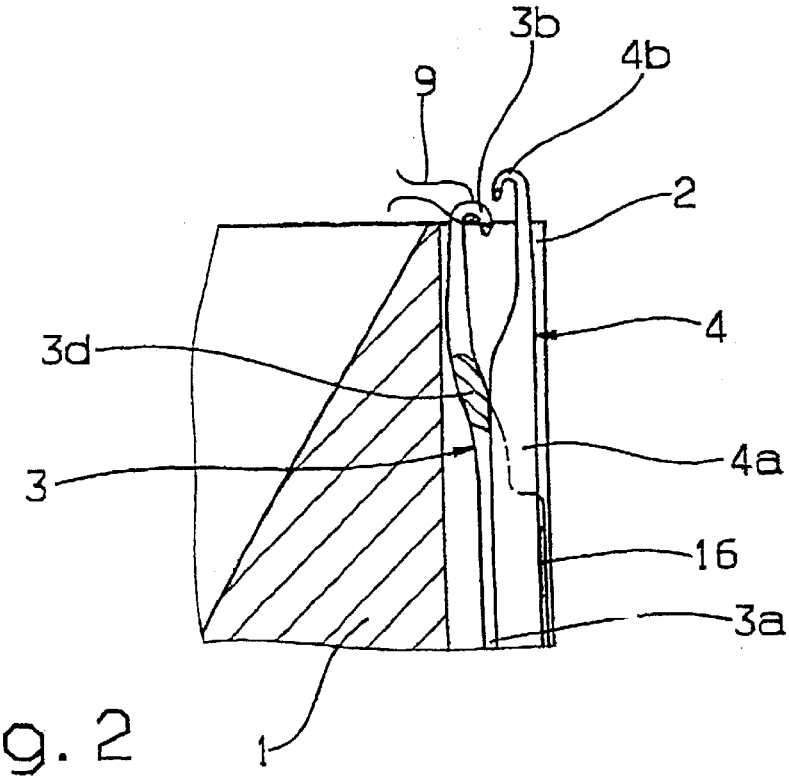
FIGS. 2 to 9 respectively one enlarged detail of the circular knitting machine according to FIG. 1 in the stitch formation region corresponding to FIG. 1 and in various positions of the compound needle during a stitch formation process.
Figure 3:
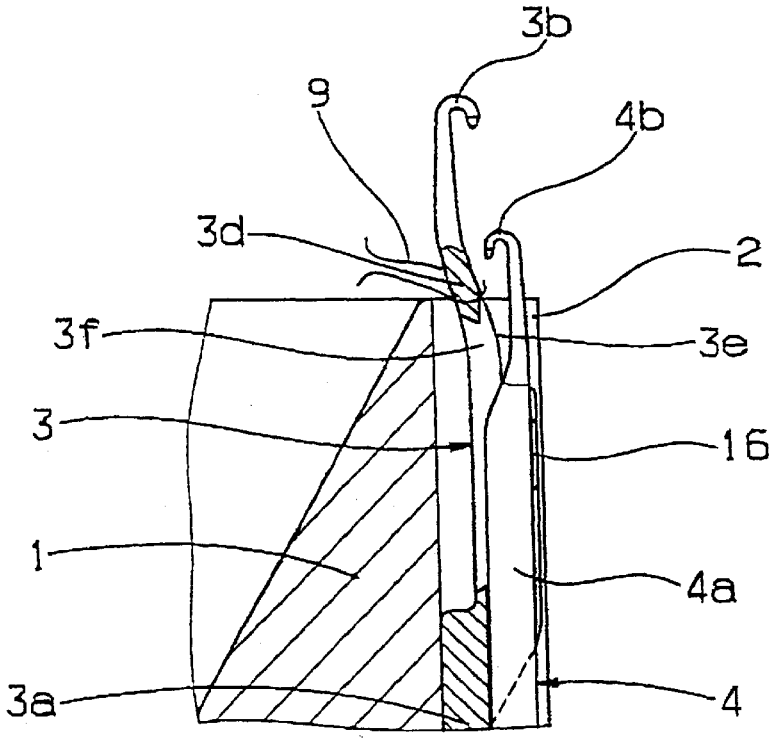
Figure 4:
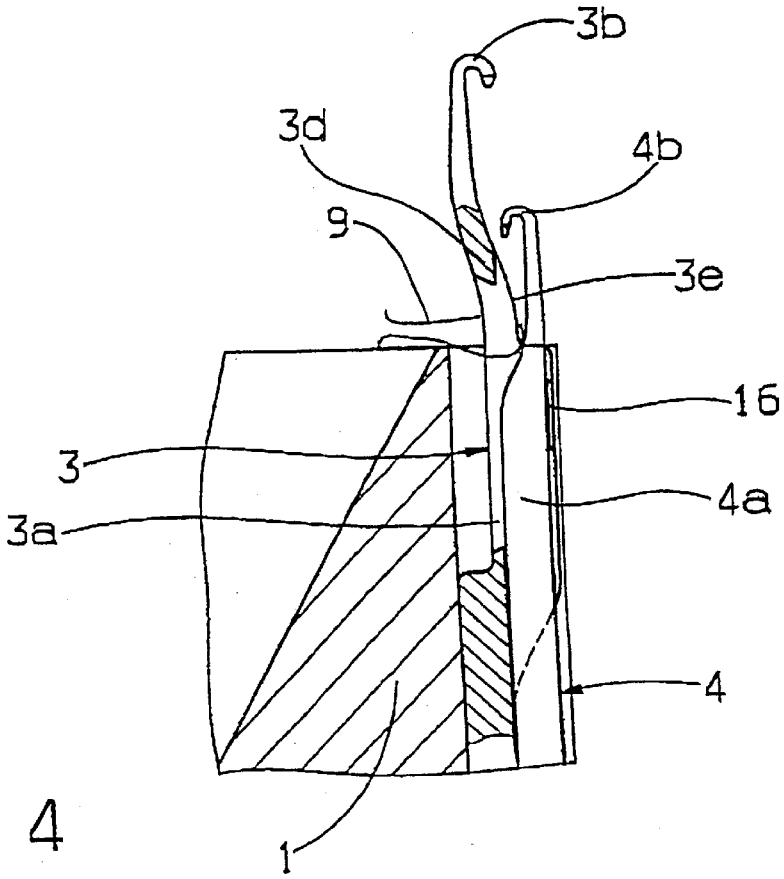

It is assumed in FIG. 2 that the needle part 3 and the slide part 4 are located in a non-knitting or rotary position and in the needle hook 3*b* there sits the stitch 9, which has been formed in a preceding stitch formation process, i.e. an "old" stitch. From this position, the needle part 3 at the commencement of a stitch formation process is expelled or raised by means of the needle cam 5 into the position which can be seen in FIG. 3, as a result of which the old stitch 9 initially reaches the radially outwardly bent front portion 3*d* and then, as FIG. 4 shows, reaches the cheek portion 3*e* of the needle shaft 3*a* and the cheek portion 3*e* comes to lie closely above the edge of the needle cylinder 1. At the same time, the slide part 4 is also raised somewhat by means of the needle cam 6 in order that the inwardly protruding slide hook 4*b* is moved out of the region of the breast portion 3*d*. These movements are continued until the positions visible in FIG. 4 are achieved, until the old stitch 9 sits on the cheek portion 3*e*.

Figure 5:
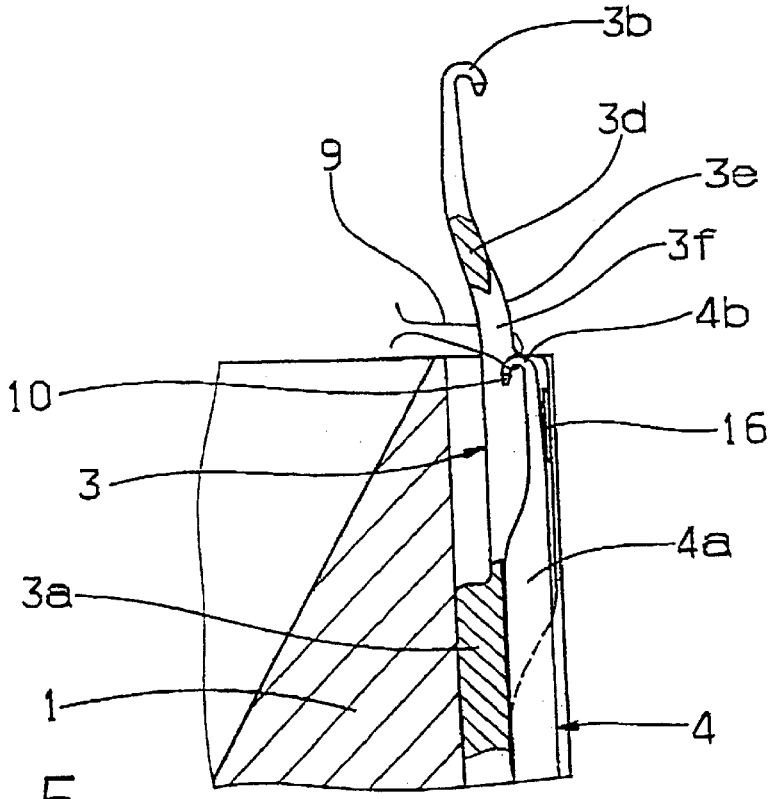
Figure 6:
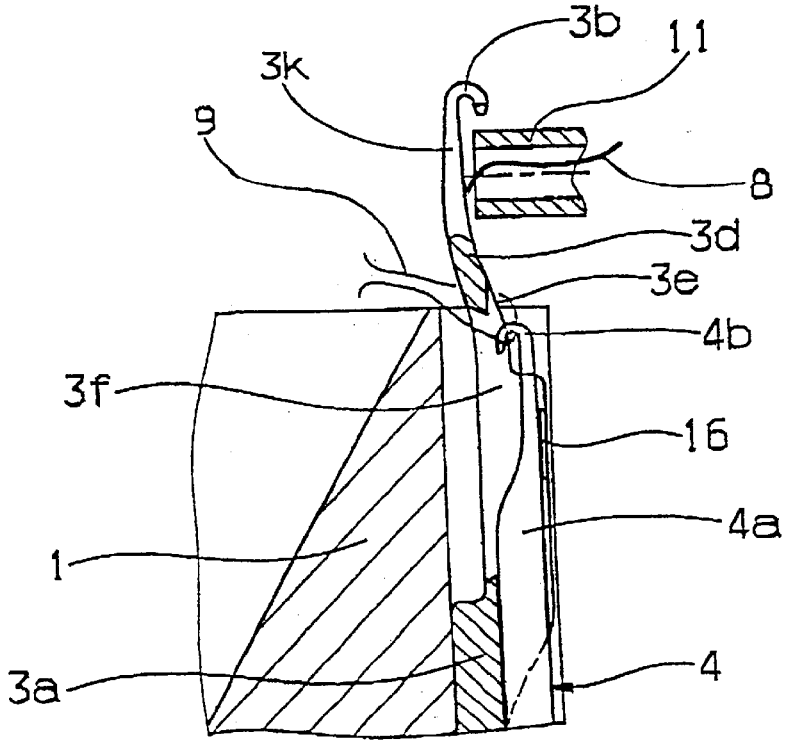
Figure 7:
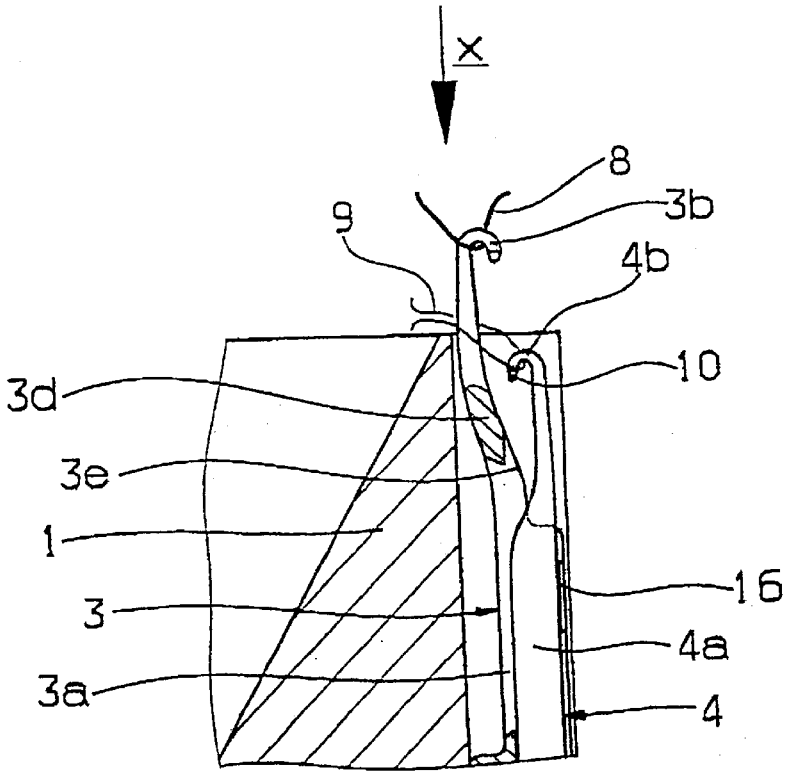

Now the slide part 4 is withdrawn by means of the needle cam 6 into the position visible in FIG. 5 in which the slide hook 4*b* is disposed closely underneath the upper edge of the needle cylinder 1. Its inwardly protruding tip 10 thereby penetrates into the slot-shaped recess 3*f* and is placed thereby from above over the old stitch 9. If now (FIG. 5) the needle part 3*a* is further raised, then the slide hook 4*b* retains the old stitch 9 until the needle part 3 adopts its highest position corresponding to the expulsion position. In this position, the new thread 8 is fed by means of a thread guide 11, whereupon the needle part 3 is again withdrawn (FIGS. 6 and 7). The slide part 4*a* remains thereby in the position according to FIG. 5.

In the further course, the needle part 3 is withdrawn even further (FIG. 8) so that, in succession, firstly the cheek portion 3*e* (FIG. 6), then the front portion 3*d* (FIG. 7) and then needle hook 3*b* and with that also the new thread 8 inserted into the latter (FIG. 8) are drawn through the old stitch 9, as a result of which a new stitch 12 is produced therefrom. Finally, the slide part 4 is raised in this position of the needle part 3 (FIG. 9) until the slide hook 4*b* stands somewhat above the upper edge of the needle cylinder 1 and consequently releases the old stitch 9 which is then drawn into the needle cylinder 1 by the tension of the already finished knitted item in a normal manner.

The next stitch formation process begins again with the raising of the needle part 3 corresponding to FIG. 2. In order that the new stitch 12 sitting now on the needle shaft 3*a* is not hereby raised by the latter, the sinkers 7 (FIG. 1), not shown in FIGS. 2 to 9, are pushed forwards in a known manner in order to enclose the old stitch 12. Correspondingly, it can be provided during the stitch formation process according to FIG. 9 to control the sinkers 7 such that the new thread 8 is withdrawn via its knock-over edges, which lie for instance at the level 14 in FIG. 1, or respectively is sunk to form a loop.

In order that the described stitch formation process can be implemented optimally and without impairment of the old and new stitch 9 or 12, the modified compound needle according to the invention is configured in such a manner as is explained in more detail subsequently with reference to FIGS. 10 to 20 which show an embodiment of the invention considered currently as the best.

According to FIGS. 10 to 12, the needle part 3 contains a rear side 3*g* with which it is supported on the base of the associated needle cylinder channel, and a front side 3*h*. The needle shaft 3*a* is provided on its front end face with a guide channel 15, which is incorporated into said end face and extends parallel to the longitudinal direction, said guide channel being able to extend across the entire length or, as FIG. 10 shows, only over a part of the length of the needle shaft 3*a*. In the embodiment, the guide channel 15 is configured in a guide portion 3*i* (cf. in particular FIG. 12), which is disposed in an upper portion of the needle shaft 3*a*, which adjoins the cheek portion 3*e*, and extends perpendicularly to the rear side 3*g* up to a greater height than the remaining part of the needle shaft 3*a*. The guide channel 15 is provided with a cover 16 orientated towards the front side 3*h* at least partially, said cover connecting two lateral cheeks forming the guide channel 15 to each other. The production of the guide channel 15 is effected for example in that (FIG. 12) the needle shaft 3*a* is machined in the region of the guide portion 3*i* from the direction of its front and rear side 3*g* or 3*h* with respectively one small circular saw 17 or 18 moved in the direction of the arrows. The circular saw 17 thereby penetrates from the rear side 3*g* up to the cover 16 in the guide portion 3*i*, as a result of which a portion of the guide channel 15 which is open towards the rear side 3*g* is produced. In contrast, with the circular saw 18 attached from the front side 3*h*, the slot- or groove-shaped recess lying between the breast portion 3*d* and the cover 16 is produced on the one hand in the cheek portion 3*e* and, on the other hand, a part of the guide channel 15 is produced, which lies on the side of the cover 16 remote from the needle hook 3*b* and penetrates only partly into the needle shaft 3*a*. Consequently, the guide channel contains a slot-shaped portion penetrating the needle shaft 3*a* and a groove-shaped portion which is delimited towards the rear side 3*g* by a base 15*a*.

Figure 13:
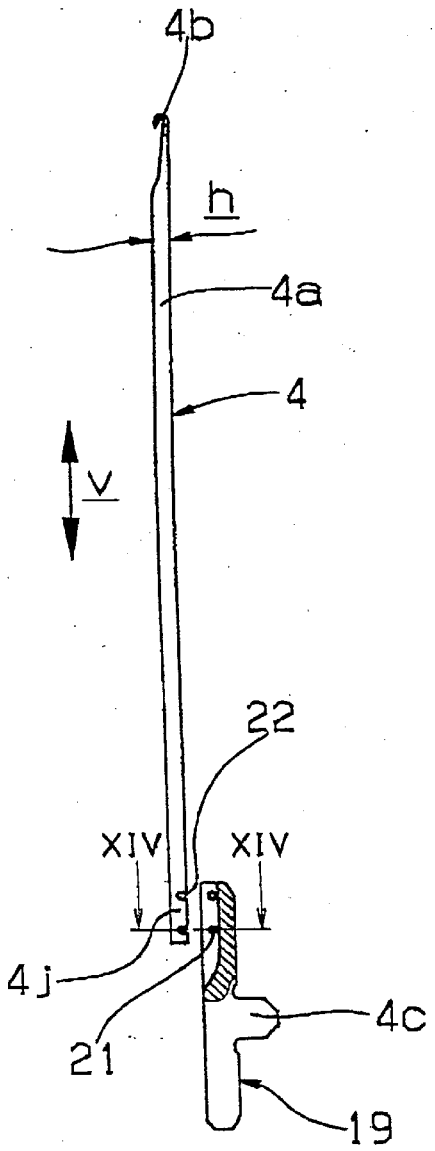
FIG. 13 a lateral view of a slide part of the compound needle according to the invention.

The slide shaft 4 has on the one hand a height h according to FIG. 13 which is essentially the same as the spacing of the base 15*a* from the cover 16 measured in the same direction and perpendicularly to the rear side 3*g*. On the other hand, the thickness d1 of the slide shaft 4*a* measured perpendicularly to the height h and perpendicularly to the longitudinal direction v is essentially the same as the width of the guide channel 15 measured in the same direction and preferably the same across the entire length of the slide shaft 4*a*. It is therefore possible to insert the slide shaft 3*a* into the guide channel 15 such that it is guided at the rear on the base 15*a*, at the front on the underside of the cover 16 covering said base and laterally by the walls of the needle shaft 3*a* delimiting the slide channel 15. In the remaining part situated between the guide portion 3*i* and the slide butt 4*c*, the slide shaft 4*a* can be supported with its rear side on the front side 3*h* of the needle shaft 3*a* and also be guided if necessary in an additional groove of the needle shaft 3*a*.

Figure 14:
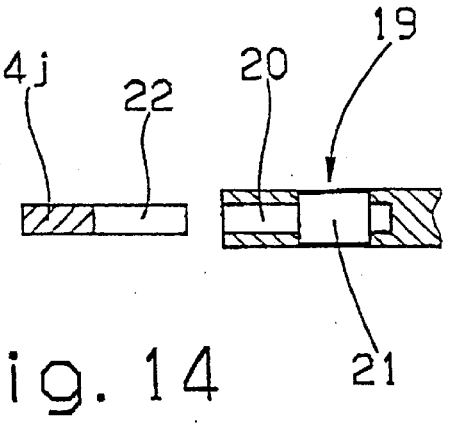
FIG. 14 a section along the line XIV—XIV of FIG. 13.
Figure 15:
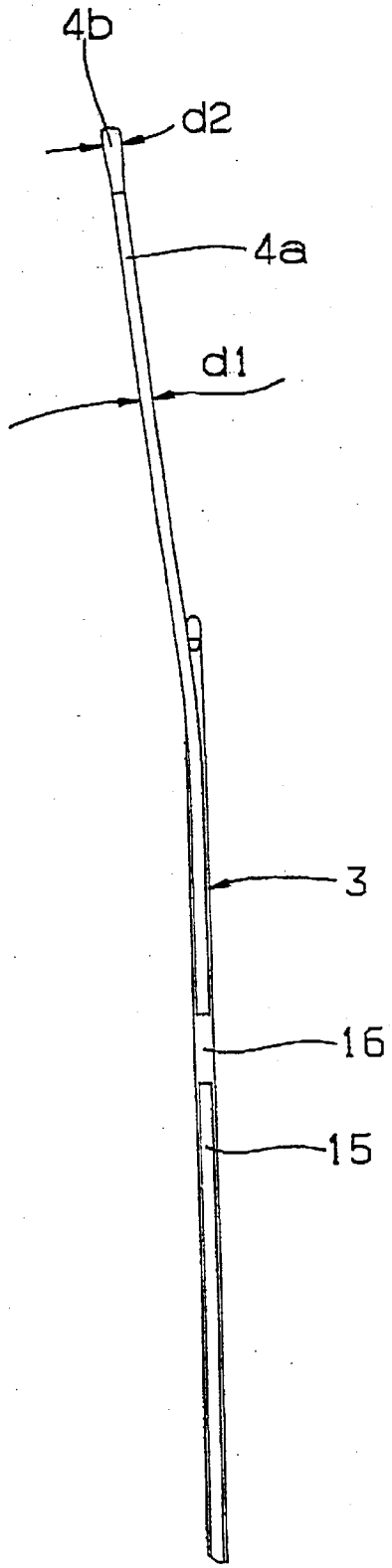
FIG. 15 a front view of the compound needle according to the invention during assembly.

The thickness of the slide hook 4*b* increases, for reasons which are explained fully further on, corresponding to FIG. 15 within a transition region from the dimension d1 to a greater dimension d2 which is greater than the width of the guide channel 15. It is therefore not possible to introduce the slide part 4 into the guide channel 15 since the slide butt 4*c* which is too high interferes on the one side and the slide hook 4*b* which is too thick interferes on the other side with the cover 16. In order to avoid this problem, it is provided according to the invention to configure the slide part 4 in two parts (FIG. 13 to 17) and in addition to provide a first element having the predominant part of the slide shaft 4*a* and the slide hook 4*b* and a second element 19 having the slide butt 4*c*. As in particular FIGS. 13 and 14 show, the second element 19 has a thickness which corresponds for example to the thickness of the needle shaft 3*a* and, on one side orientated towards the slide shaft 4*a*, has a U-shaped receiving groove 20 into which a lower end 4*j* of the slide shaft 4*a* which is distant from the slide hook 3*b* can be inserted.

Figure 16:
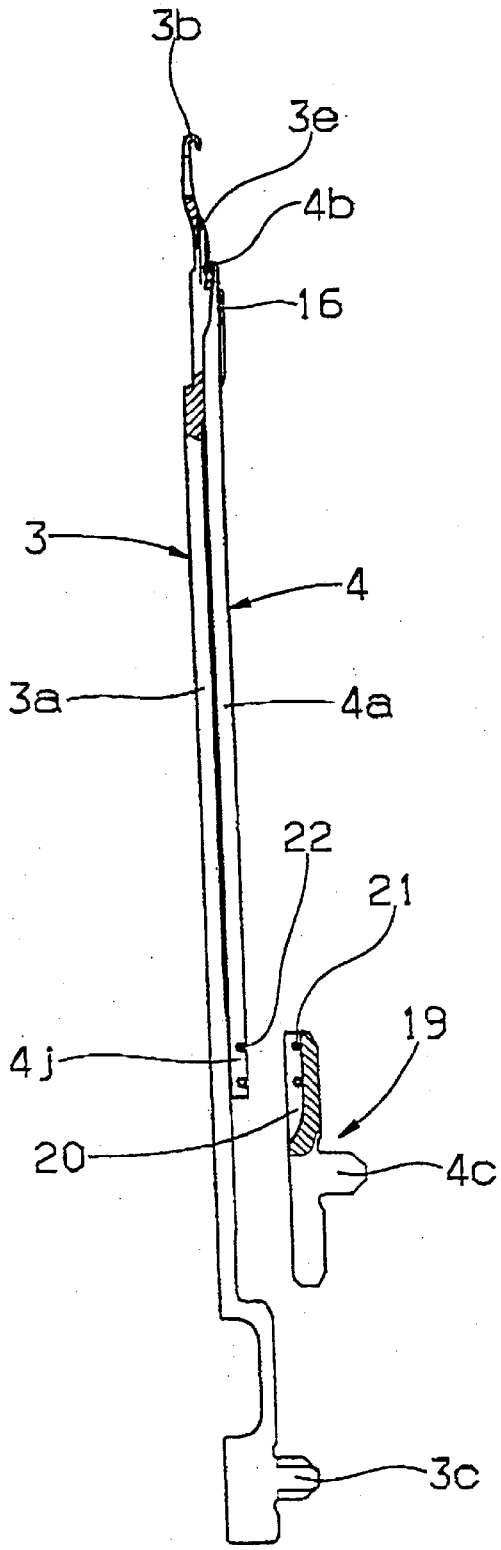
FIGS. 16 and 17 respectively a lateral view of the compound needle according to the invention in various assembled positions.
Figure 17:
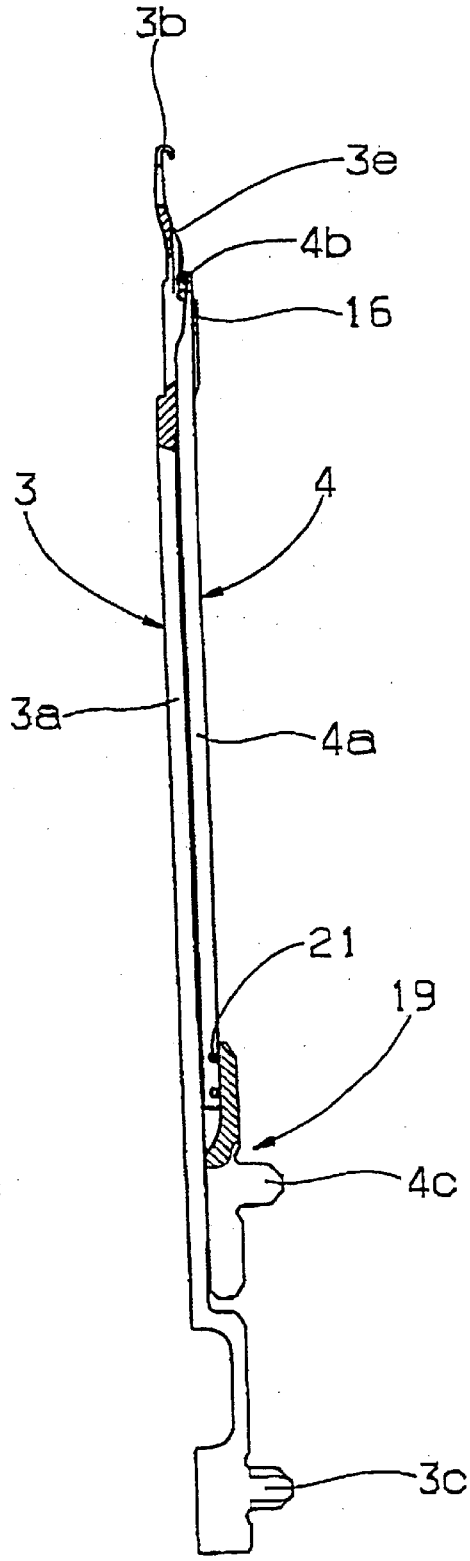

Because of the two-part configuration of the slide part 4, it is possible to introduce the slide shaft 4*a* with its end 4*j* corresponding to FIG. 15 from the side of the needle hook 3*b* into the guide channel 15 and to move it forward in the latter until the slide shaft 4*a*adopts the position in longitudinal direction v relative to the needle part 3 which can be seen in FIGS. 16 and 17. Should it not be possible to move the slide shaft back, which projects backwardly somewhat relative to the slide hook 4*b* and which is to be positioned on the base 15*a* of the guide channel 15, past the outwardly situated tip of the needle hook 3*b*, the slide shaft 4*a* can be somewhat elastically bent due to its elasticity conditioned by the low thickness d1 and consequently be introduced laterally past the needle hook 3*b* into the guide channel 15, as indicated in FIG. 15.

If the slide shaft 4*a* is disposed correctly in the guide channel 15 (FIG. 16), the element 19 is connected firmly or detachably to the lower end 4*j* of the slide shaft 4*a*. The means used for this purpose are arbitrary per se. In the embodiment, it is proposed to provide the end 4*j* and the element 19 with coupling elements which cooperate in the manner of snap-on connections. For this purpose, the element 19 has for example two pins 21, which protrude transversely through the receiving groove 20 and are connected with the walls of the element 19 delimiting the receiving groove 20 by means of welding, soldering or otherwise, whilst the end 4*j* obtains at its front side corresponding open edge recesses 22 which can be clipped onto the pins 21. After clipping on the element 19, the slide part 4 is connected then securely and captively but displaceably with the needle part 3 in the direction of the double arrow v. It is thereby assumed that the slide shaft 3*a* and the element 19 are produced from the normal materials for needles of the type of interest here, in particular from metals.

Figure 18:
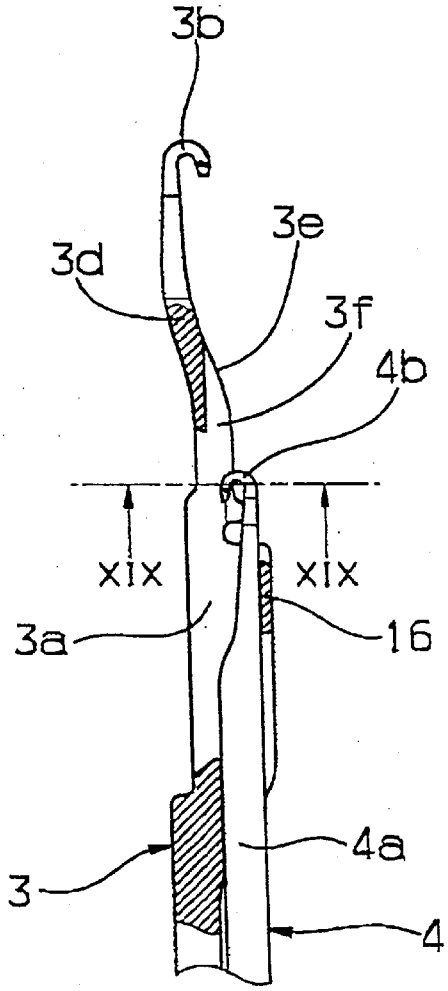
FIG. 18 an enlarged, partially sectioned illustration of the compound needle according to the invention in the region of its stitch formation portions.
Figure 19:
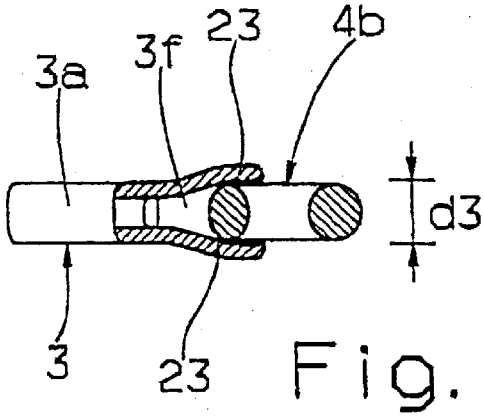
FIG. 19 an enlarged section along the line XIX—XIX through the compound needle according to FIG. 18.

FIGS. 18 and 19 show in enlarged illustrations the thickening of the slide hook 4*b* according to the invention. If the slide hook 4*b* is given a thickness d2 (FIG. 15), which corresponds approximately to the thickness of the needle part 3, it cannot readily be introduced into the recess 3*f* incorporated into the front side 3*h* of the needle shaft 3*a*, as would be required for example according to FIG. 5 and 6 during a stitch formation process. It is therefore provided according to the invention (FIG. 19) to widen the needle shaft 3*a* in the region of its two side cheeks 23 forming the cheek region 3*e* at the sides, i.e. in the direction of the thickness dimension d2 until the clear width of the recess 3*f* (=dimension d3 in FIG. 19), measured in this direction, is somewhat greater than corresponds to the thickness d2 of the slide hook 4*b*. As a result, the slide hook 4*b* itself can then enter securely into the recess 3*f* even if it has almost the same thickness as the needle shaft 3*a*, as FIG. 19 shows.

Figure 20:
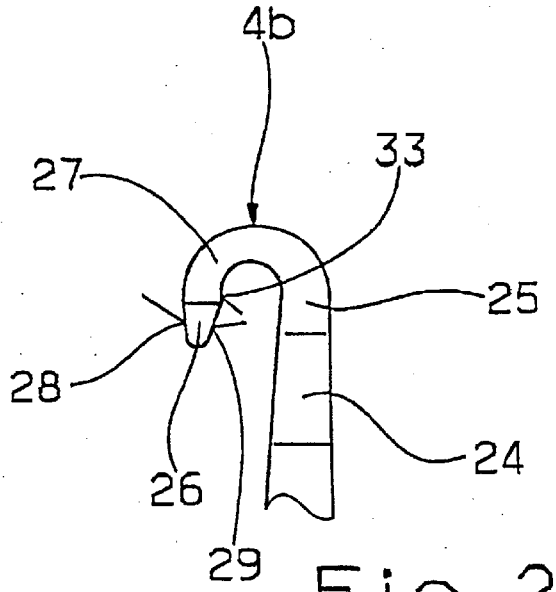
FIGS. 20 and 21 respectively an enlarged front view and lateral view of the hook of the slide part according to FIG. 13.
Figure 21:
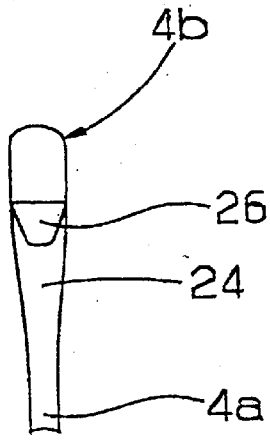

It can be provided furthermore according to FIG. 20 and 21 to make the slide hook 4*b* increase in a comparatively long transition region 24 (FIG. 20) from the thickness d1 to the thickness d2 which is achieved in an outwardly situated hook portion 25, and, in its portion 27, which has a free hook tip 26 and is orientated towards the needle part 3, to configure it in any expedient manner. It is particularly advantageous to configure the portion 27 asymmetrically in lateral view, as FIG. 20 shows. Accordingly, the portion 27 at its side orientated towards the needle shaft 3*a* has a face 28 configured essentially parallel to its rear side 3*g*, said face promoting the threading and guiding of the hook tip 26 in the recess 3*f*. In contrast, the face of the mentioned hook portion 27 orientated away from the needle shaft 3*a* is provided with a face 29 disposed diagonally relative to the rear side 3*g* of the needle shaft 3*a*, said face facilitating and promoting the take-over of the old stitch 9 during movement of the slide part 4 from the position according to FIG. 4 into the position according to FIG. 5.

Figure 22:
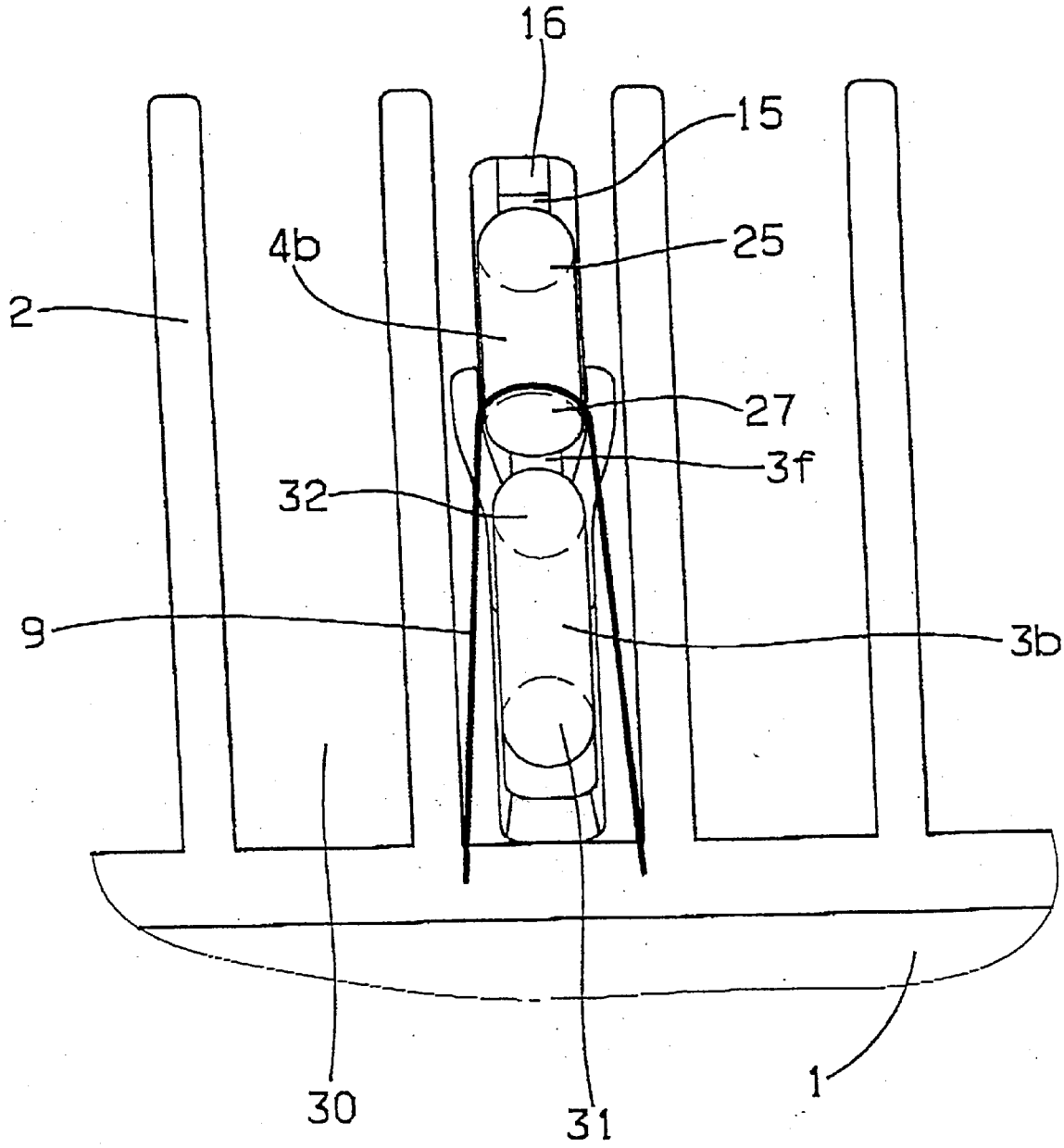
FIG. 22 a schematic plan view of the circular knitting machine according to FIG. 7 in the direction of an arrow X.

Finally, FIG. 22 shows in a schematic plan view of the needle and slide part position according to FIG. 7 a few needle webs 2 of the needle cylinder 1 which are situated next to each other, needle channels 30 formed between these and a pair comprising a needle part 3 and a slide part 4 disposed between two needle webs 2. In the plan view there are thereby visible essentially only the two lateral cheeks 23 with the recess 3*f* situated between said lateral cheeks (cf. also FIG. 19), the needle hook 3*b* and the slide hook 4*b*. The hook portions 25, 27 according to FIG. 20 and two corresponding needle hook portions 31, 32 are indicated respectively in FIG. 22 in broken lines.

Figure 8:
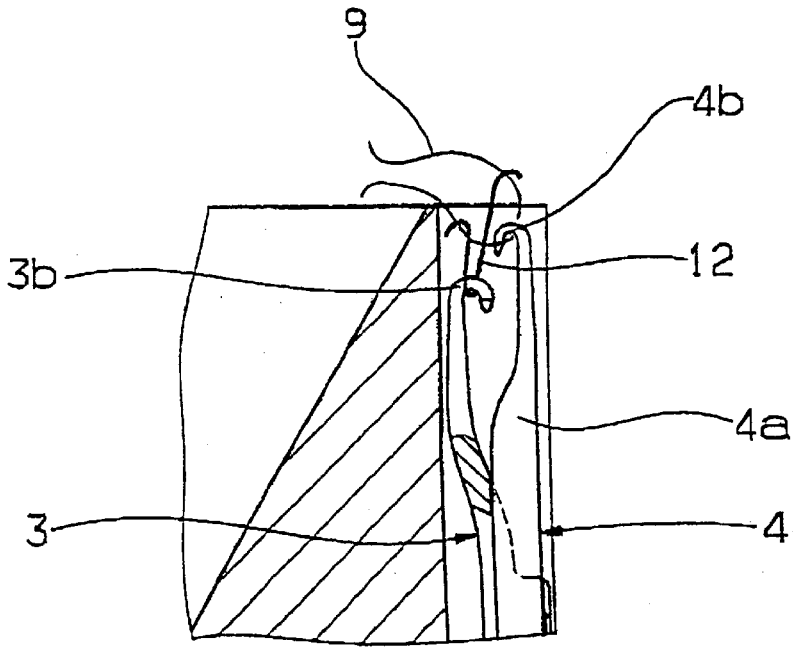
Figure 9:
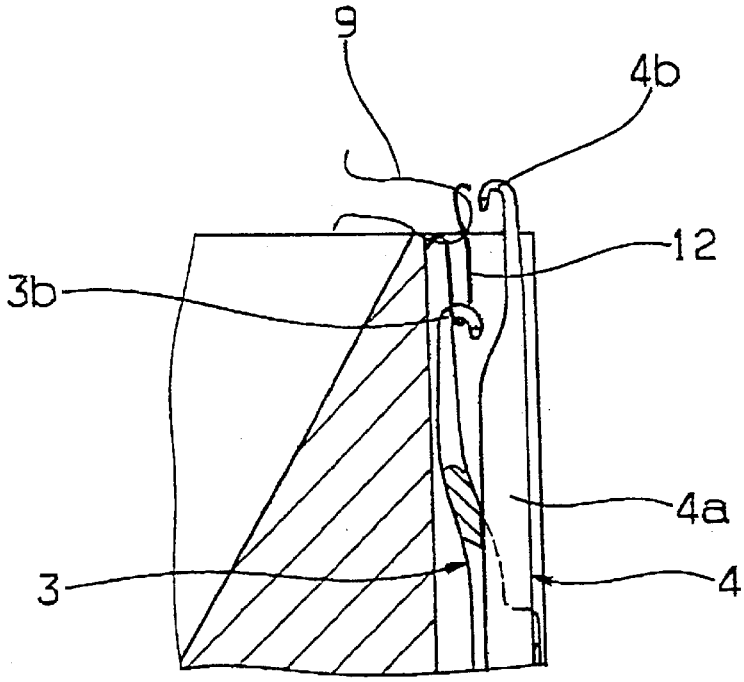

It is evident in particular from FIG. 22 that, during the stitch formation process, the old stitch 9 also illustrated in FIGS. 7 and 8, is spread transversely relative to the needle cylinder webs 2 practically only by the portion 27 of the slide hook 4*b* and in fact by a face- or spread portion 33 illustrated in FIG. 20 and changing into the face 29. The slide hook 4*b* according to the invention is therefore configured such that it is sufficiently thick in particular also in the region of this spread portion 33. Consequently, a good spreading effect with respect to the stitch 9 is obtained so that the external portion 32 of the needle hook 3*b* orientated towards the slide hook 4*b* and carrying the new thread 8 according to FIGS. 7 and 8, can be very readily drawn through the old stitch 9 spread by the slide hook 4*b* even if the thickness of the spread portion 33 corresponds approximately to the thickness of the needle shaft 3*a* (dimension d4 in FIG. 11).

It is clear furthermore that the needle shaft thickness is determined essentially by the gauge of the needle cylinder 1. In the case of a 28-type gauge (=28 needles per inch), the average spacing of the needle webs 2 is for example approximately 0.91 mm, the thickness d4 of the needle shaft is for example 0.41 mm and the thickness of the needle hook 3*b* at for example 0.38 mm is only slightly less. In the embodiment, the dimension d2 (FIG. 15) for the slide hook 4*b* is chosen essentially to be equally as big as the dimension d4, whilst the slide shaft thickness d1 is only approximately 0.2 mm, since otherwise the guide channel 15 cannot be produced reliably. It is provided finally in the embodiment to widen the lateral cheeks 23 in the region of the cheek portion 3*e* until, on the one hand, the width of the recess 3*f* suffices to receive the slide hook 4*b* and, on the other hand, the spacing of the lateral cheeks 23 measured at the external sides is still somewhat smaller than the clear width of the needle channels 30 prescribed by the gauge. If this is not possible with the required clearance freedom, it is provided in a particularly preferred embodiment of the invention to configure the needle channels 30, at least in that region in which the widened cheek portion 3*e* must move up and down, to be slightly wider and the needle webs 2 to be thinner by a corresponding value than is common with the respective gauge.

As FIG. 22 shows, the old stitch 9 is sufficiently spread by the portion 27 or the spread portion 33 of the slide hook 4*b*, configured to be thicker than normal. It would therefore also be possible to configure only this portion 27 or 33 more thickly than the slide shaft 4*a*. The described embodiment offers the advantage however that the slide hook 4*b* does not need to be machined separately and hence can be configured smoothly and without comers and edges, which is favourable for sparing the threads to be worked.

FIG. 22 shows furthermore that it would also be possible to choose the portion 32 of the needle hook 3*b* or even the total needle hook 3*b* to be thinner than normal and in particular to be so thin that the portion 32, during its downwards movement from the position according to FIG. 7 into the position according to FIG. 8, penetrates reliably through the old stitch 9 which is spread by the slide hook 4*b* without damaging said stitch. The slide hook 4*b* could then have the same thickness continuously as the slide shaft 4*a*. Finally, it would be possible as an alternative to configure both the slide hook 4*b* in the above-mentioned sense to be somewhat thicker and to configure the needle hook 3*b* to be correspondingly somewhat thinner.

Tests have shown that an adequate spreading of the old stitch 9 is achieved when the thickness d2 of the slide hook 4*b* or of the portion 27, 33 is at least approximately 80% of the thickness of the needle hook 3*b* or of the thickness of its portion 32. In addition the described construction ensures that the slide hook 4*b* securely grasps and takes over the old stitch 9 when entering into the recess 3*f* (FIG. 5) without damaging said stitch.

In order that the thread 8 (FIG. 6) can be placed securely in the needle hook 3*b* when using the modified compound needle according to the invention, the needle part 3 between the needle hook 3*b* and the breast portion 3*d* or in its absence between needle hook 3*b* and the cheek portion 3*e* has preferably a further portion 3*k* described here as "thread feed portion" (FIGS. 6, 10 and 11). In the longitudinal direction v, this has a length of preferably at least approximately 2 mm and, at its external or front side, an external contour extending extensively parallel to the longitudinal direction v. Consequently it is possible, as FIG. 6 shows, to dispose the preferably tubular thread guide 11, which is suitable for feeding commonly used threads, by its feed end closely to the thread feed portion 3*k* and hence directly under the needle hook 3*b* and to ensure secure placement of the thread 8 in the needle hook 3*b*.

The invention is not restricted to the described embodiments which can be modified in many ways. This applies in particular to the illustrated and described sizes, gauges configurations of the various parts which can be configured also in another manner within the scope of the invention. It is clear thereby that the thickness of the slide hook 4*b* is delimited upwardly by the maximum width of the needle cylinder grooves 30, whilst the lower limit, in the case of a tapering of the needle hook 3*b*, is essentially prescribed by the stability of the needle hook 3*b* which is required for withdrawal of the thread 8. Furthermore, the compound needle according to the invention can be used not only with circular knitting machines but also with flat knitting, warp knitting or hosiery machines and above all also with circular knitting machines with two needle beds, in particular in the form of needle cylinders and dials. It is understood finally that the various features can also be applied in combinations other than those which have been illustrated and described.

It will be understood, that each of the elements described above, or two or more together, may also find a useful application in other types of constructions differing from the types described above.

While the invention has been illustrated and described as a compound needle embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. Compound needle for knitting, warp knitting or hosiery machines, comprising: a needle part (3) with a needle shaft (3*a*) and a needle hook (3*b*), said needle shaft (3*a*) having a front side (3*h*) with a slot-shaped recess (3*f*), a rear side (3*g*), a longitudinal direction (v) and a guide channel (15) extending in said longitudinal direction, and a slide part (4) having a slide shaft (4*a*) being insertable into said guide channel (15) and being moveable to and fro in said guide channel (15) and a slide hook (4*b*) being open in the opposite direction to said needle hook (3*b*), said slide hook (4*b*) being insertable at least partially into said recess (3*f*) in order to take over a stitch (9) located on said needle shaft (3*a*), wherein said guide channel (15) has a cover (16) bridging said slide shaft (3*a*) at least on a part of its length and wherein, for making safe said taking over of said stitch (9), said slide hook (4*b*) has a thickness (d2) being greater at least in a spread portion taking over said stitch (9) and keeping it wide than a width of the guide channel (15), and/or said needle hook (3*b*) has a thickness being smaller than a thickness (4*d*) of said needle shaft (3*a*).

2. Compound needle according to claim 1, wherein said slide shaft (4*a*) on its total length has a thickness (d1) being essentially the same as said width of said guide channel (15).

3. Compound needle according to claim 1, wherein said guide channel (15) is open towards said rear side (3*g*) of said needle shaft (3*a*) at least in a region of said cover (16).

4. Compound needle according to claim 1, wherein said needle part (3) has a thread feed portion (3*k*) being disposed between said needle hook (3*b*) and said cheek portion (3*e*) and being intended for disposing a thread guide (11).

5. Compound needle according to claim 4, wherein said thread feed portion (3*k*) has a length measured in said longitudinal direction (v) of said needle shaft (3*a*) of at least 2 mm.

6. Compound needle according to claim 1, wherein said slide part (4) is configured in two parts and has a first element (4*a*) which has said slide hook (4*b*) and a second element (19) which is provided with a slide butt (4*c*).

7. Compound needle according to claim 6, wherein said first and said second part (4*a*, 19) have coupling elements (21, 22) being detachably connectable to each other.

8. Compound needle according to claim 7, wherein said coupling elements (21, 22) comprise snap-on connection elements.

9. Compound needle according to claim 1, wherein said needle hook (3*b*) is narrowed relative to said needle shaft (3*a*) in such a manner that said width of said guide channel (15) is at least approximately 80% of a thickness of at least a portion (32) of said needle hook (3*b*) orientated towards said slide hook (4*b*).

10. Compound needle according to claim 1, wherein said entire slide hook (4*b*) is thicker than said width of said guide channel (15).

11. Compound needle according to claim 10, wherein said thickness (d2) of said spread portion (33) of said slide hook (4*b*) is at least approximately 80% of the thickness of a portion (32) of said needle hook (3*b*) facing towards said slide hook (4*b*).

12. Compound needle according to claim 1, wherein said recess (3*f*) is configured in a widened cheek portion (3*e*) of said needle shaft (3*a*).

13. Knitting machine, having at least one needle bed (1), which is provided with a multitude of needle webs (2) and channels (30) disposed between these, in which channels compound needles (3, 4) are mounted displaceably, characterised in that the compound needles (3, 4) are configured according to claim 1.

14. Knitting machine according to claim 13, characterised in that the channels (30) are configured to be wider in regions in which the widened cheek portions (3*e*) of the needle parts (3) are mounted and the needle webs (2) forming the latter are configured to be correspondingly thinner than in the remaining regions.

15. Knitting machine according to claim 13, characterised in that it is configured as circular knitting machine which has two needle beds in the form of a needle cylinder and a dial respectively, and in that both needle beds are equipped with compound needles (3, 4) according to claim 1.

* * * * *